US006496999B1

(12) United States Patent
Gleason et al.

(10) Patent No.: US 6,496,999 B1
(45) Date of Patent: Dec. 24, 2002

(54) TOOTHBRUSH WITH BRISTLE CONFIGURATION ADAPTED FOR CLEANING TOOTH SURFACES AND INTERPROXIMAL AREAS

(75) Inventors: Mark D. Gleason, Buffalo Grove, IL (US); Dominic Squillaci, Lake Villa, IL (US); Kevin G. Yost, Winnetka, IL (US); Christopher J. Stvartak, Skokie, IL (US)

(73) Assignee: John O. Butler Company, Chicago, IL (US)

( * ) Notice: Subject to any disclaimer, the term of this patent is extended or adjusted under 35 U.S.C. 154(b) by 0 days.

(21) Appl. No.: 09/496,696

(22) Filed: Feb. 2, 2000

(51) Int. Cl.[7] ..... A46B 9/04

(52) U.S. Cl. ..... 15/167.1; 15/207.2; 15/DIG. 5; 15/DIG. 6; D4/104

(58) Field of Search ..... 15/167.1, 207.2, 15/DIG. 5, DIG. 6; D4/104

(56) References Cited

U.S. PATENT DOCUMENTS

| | | | | | |
|---|---|---|---|---|---|
| 74,560 | A | | 2/1868 | Maury | 15/167.1 |
| D17,383 | S | | 6/1887 | Thompson | D4/130 |
| 958,371 | A | | 5/1910 | Danek | 15/167.1 |
| D45,198 | S | | 2/1914 | McDonagh et al. | D4/104 |
| D45,199 | S | | 2/1914 | McDonagh et al. | D4/104 |
| 1,323,042 | A | * | 11/1919 | Gardner | 15/167.1 |
| 2,083,217 | A | * | 6/1937 | Brothers et al. | 15/167.1 |
| 2,186,005 | A | * | 1/1940 | Casto | 15/167.1 |
| 2,426,328 | A | | 8/1947 | Wandel et al. | 300/21 |
| 2,812,530 | A | | 11/1957 | Whitesel | 15/207.2 |
| 3,188,673 | A | | 6/1965 | Newman | 15/167.1 |
| D201,867 | S | | 8/1965 | Newman | D4/104 |
| 3,295,156 | A | | 1/1967 | Brant | 15/167.1 |
| 3,792,504 | A | * | 2/1974 | Smith | 15/167.1 |
| 3,877,753 | A | | 4/1975 | Ripstein | 300/21 |
| D243,568 | S | | 3/1977 | Axelsson | D4/104 |
| 4,033,008 | A | | 7/1977 | Warren et al. | 15/167.1 |
| 4,679,273 | A | | 7/1987 | Okin | 15/167.1 |
| 4,979,782 | A | | 12/1990 | Weihrauch | 300/4 |
| 5,305,489 | A | | 4/1994 | Lage | 15/167.1 |
| 5,459,898 | A | | 10/1995 | Bacolot | 15/106 |
| 5,511,275 | A | | 4/1996 | Volpenhein et al. | 15/167.1 |
| D372,363 | S | | 8/1996 | Halm | D4/104 |
| 5,570,487 | A | | 11/1996 | Schneider | 15/167.1 |
| 6,138,314 | A | * | 10/2000 | Schiff et al. | 15/167.1 |
| 6,322,152 | B2 | * | 11/2001 | Trojanowski et al. | 15/167.1 X |

FOREIGN PATENT DOCUMENTS

| | | | | |
|---|---|---|---|---|
| DE | 2728672 | * | 1/1979 | 15/207.2 |
| DE | 3528596 | * | 2/1987 | 15/167.1 |
| FR | 642228 | * | 8/1928 | 15/167.1 |
| GB | 897404 | * | 5/1962 | 15/207.2 |
| JP | 6-304002 | * | 11/1994 | 15/167.1 |
| SE | 81229 | * | 8/1934 | 15/167.1 |
| WO | WO 98/38889 | | 9/1998 | |

* cited by examiner

*Primary Examiner*—Mark Spisich
(74) *Attorney, Agent, or Firm*—Michael Best & Friedrich, LLC

(57) ABSTRACT

A toothbrush which is particularly well adapted for properly cleaning tooth surfaces and interproximal areas having a plurality of tufts of bristles mounted in the head of the toothbrush with the tufts cut in a series of at least two rounded peaks extending laterally across the head and in which the tufts of bristles may be arranged in at least two longitudinally disposed outer rows defining an inner area lying therebetween and at least one longitudinally disposed inner row is positioned in the inner area, with the tips of the inner row of tufts of bristles being feathered.

21 Claims, 3 Drawing Sheets

TOOTHBRUSH WITH BRISTLE CONFIGURATION ADAPTED FOR CLEANING TOOTH SURFACES AND INTERPROXIMAL AREAS

BACKGROUND OF THE INVENTION

The present invention relates generally to dental hygiene and, more particularly, to toothbrushes which are particularly well suited to reach into and remove plaque and debris from the gingival sulcus and to clean exposed tooth surfaces.

Most dentists recommend that their patients use the Bass method of tooth brushing. This technique is the most widely recommended method for removing plaque from the gingival sulcus and from the exposed surfaces of the teeth. The Bass method requires that the toothbrush head be positioned along the gum line at approximately a 45 degree angle, with at least one row of bristles nestled below the gumline. While the brush head is oriented in this way, it is gently rocked back and forth so that bristles in the gingival sulcus loosen and remove plaque which is present there while the rest of the bristles brush and massage the exposed surface of the gum and clean the exposed tooth surfaces. The bristles are then swept away from the gumline. The brush head is then lifted away and repositioned to perform the same process with adjacent teeth and gums. An important objective of this technique is to reduce targeted pathogenic organisms found in the gingival sulcus which, among other things, will minimize or eliminate gingival inflammation and bleeding.

Toothbrushes with a wide variety of bristle configurations are available. The most common toothbrush design comprises a handle with a flat head and tufts of bristles of substantially the same length projecting from the head. The tips of the bristles in these conventional toothbrushes therefore lie generally in a plane. This design is not particularly well-suited to the Bass method because the bristles which contact the outer tooth surfaces and the outer surfaces of the gums below the gum line impede penetration of the remaining bristles into the gingival sulcus or into the spaces between adjacent teeth.

Other current toothbrush head designs have outer longitudinal rows of bristles which are longer than the rows of bristles lying in the inner portion of the brush. This design is not well suited to the Bass method because the outer bristles tend to lay on top of the gingiva, rather than penetrating into the gingival sulcus. Yet another toothbrush bristle head design which has been suggested comprises groupings of tufts of bristles with tips at two different heights. In this design, the tufts are arranged in alternating, laterally extending rows shaped to form either a square wave configuration or a triangular wave configuration. In both cases, the design offers little in the way of penetration of the gingival sulcus when the Bass technique is used. Furthermore, the sharp transition in bristle length at the corners of the square or triangular wave configurations are potentially irritating and uncomfortable.

Toothbrush designs have included bristle tips cut laterally across the longitudinal axis of the head of the toothbrush to produce a dome configuration. This configuration does have advantages with respect to the Bass technique, since the outer rows of bristles are shorter than the inner rows and do not interfere with penetration of the inner rows into the gingival sulcus.

Techniques for increasing effective bristle tip area by feathering the tips of the bristles in a variety of different kinds of brushes have been known for some time. These techniques have been applied to various toothbrush bristle configurations, including some of the configurations discussed above. Also, selective feathering of bristles has been suggested in the past. While feathering may improve the overall performance of many toothbrushes, it has had little impact on the effectiveness of earlier brushes in cleaning the gingival sulcus because the bristle tuft configurations have not been well-suited to the Bass method. Furthermore, although increasing the effective bristle tip area would further improve the cleaning achieved with the dome configuration discussed immediately above, this has not been suggested in the past.

The present invention provides a new toothbrush head design with an ideal configuration of bristle tuft lengths as well as feathering of selected bristle tips. The resulting toothbrush is gentle but effective, providing outstanding overall comfort as well as greatly enhanced effectiveness in reaching into and removing plaque and debris from the gingival sulcus, massaging the gum both above and below the gum line, and cleaning exposed tooth surfaces including the spaces between adjacent teeth.

SUMMARY OF THE INVENTION

The present invention is directed to a toothbrush having an elongated handle with an elongated head at one end. A plurality of tufts of bristles are mounted in the head and project generally perpendicularly from it. The tips of the tuft bristles are cut to form an undulating surface comprising at least two rounded peaks extending generally laterally across the head of the toothbrush.

The plurality of tufts of bristles mounted in the toothbrush head may include at least two longitudinally disposed outer rows, one along each of the opposite outer edges of the head, defining an inner area lying therebetween, and at least one longitudinally disposed inner row of tufts positioned in this inner area. The tips of the bristles in the inner rows of tufts of bristles are feathered.

In one preferred embodiment, the tips of the tufts of all or only the inner row(s) of bristles are also cut in a rounded profile that arches upwardly across the longitudinal axis of the head. Also, in another preferred embodiment of the invention, the undulating surface is made up of at least three rounded peaks. In yet another preferred embodiment, some of the tufts of bristles of the inner row(s) extend beyond the last tufts of the bristles in the outer rows.

BRIEF DESCRIPTION OF THE DRAWINGS

While the specification concludes with claims which particularly point out and distinctly claim the invention, it is believed that the present invention will be better understood from the following description of several preferred embodiments taken in conjunction with the accompanying drawings, in which like reference numerals identify similar elements and wherein:

DESCRIPTION OF THE PREFERRED EMBODIMENTS

Figure 1:
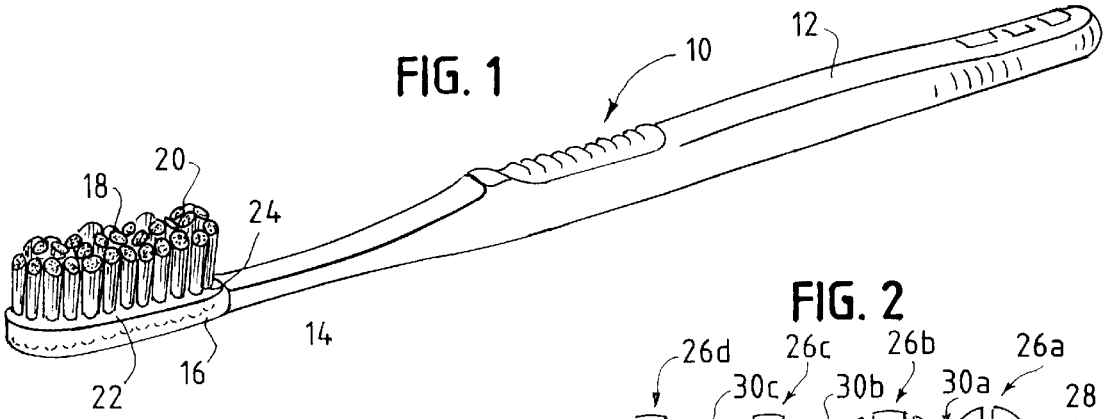
FIG. 1 is a perspective view of a toothbrush in accordance with the present invention.

In a preferred embodiment of the invention as depicted in FIG. 1, a toothbrush 10 is shown, with an elongated a handle 12, a neck 14 and an elongated head 16. A plurality of bristles 18 arranged in tufts 20 are mounted in the head so that they project from the face 22 of head 16. In a preferred embodiment, the bristles project generally perpendicularly from the face of the head. The bristle tufts may be attached to head 16 by any conventional technique, such as by the use of small metal clips (not shown) that are forced into holes 24 that are preformed into the face of the toothbrush head. Alternatively, the bristles may be attached with the use of adhesives or by fusing the bristles to the toothbrush head. The size and number of tufts of bristles can be adjusted depending on the size of the toothbrush head desired. For example, a smaller head with fewer or smaller bristle tufts than shown could be used for a toothbrush appropriately sized for use by young children.

Figure 2:
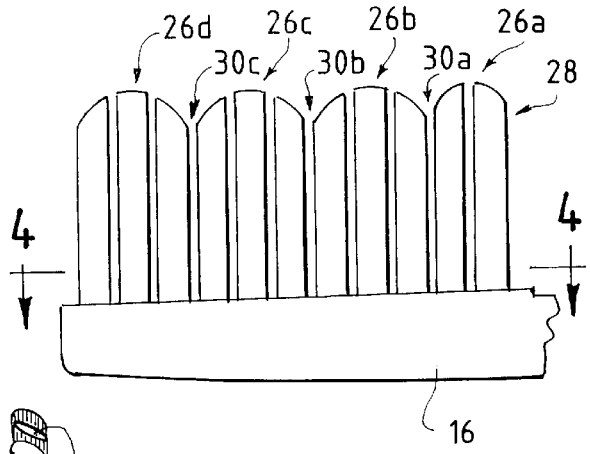
FIG. 2 is a diagrammatic side elevation view of the head of the toothbrush of FIG. 1.
Figure 3:
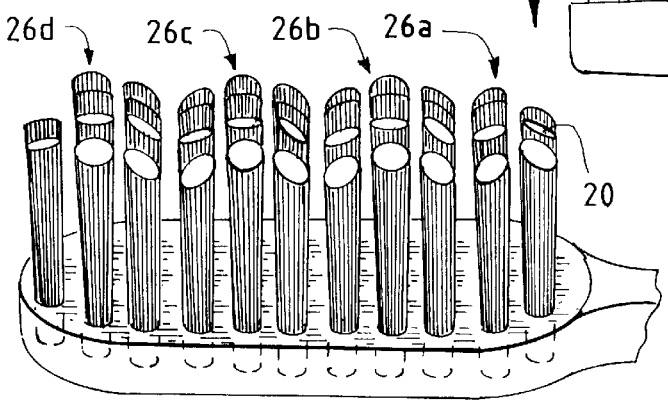
FIG. 3 is a side elevation view of the head of the toothbrush of FIG. 1 in which the toothbrush has been rotated forward along its longitudinal axis.

Turning now to FIGS. 2 and 3, brush head 16 is shown in side elevation view, with a series of rounded peaks 26*a,* 26*b,* 26*c* and 26*d* of tufts of bristles represented diagrammatically. As can be seen in this figure, the rounded peaks presentation undulating top surface 28. In this particular embodiment, the undulating surface comprises four rounded peaks with indentations or "valleys" 30*a,* 30*b* and 30*c* between adjacent peaks. Each of these peaks and valleys extend laterally across the head of the toothbrush, as illustrated in FIG. 3.

The rounded shape of the peaks insures that the tufts make their way into the spaces between adjacent teeth. The rounded shape of the peaks also avoids the potential risk of gingival abrasion associated with the triangular or square wave configurations of the prior art discussed above and makes for a toothbrush which is much more comfortable to use.

Figure 4:
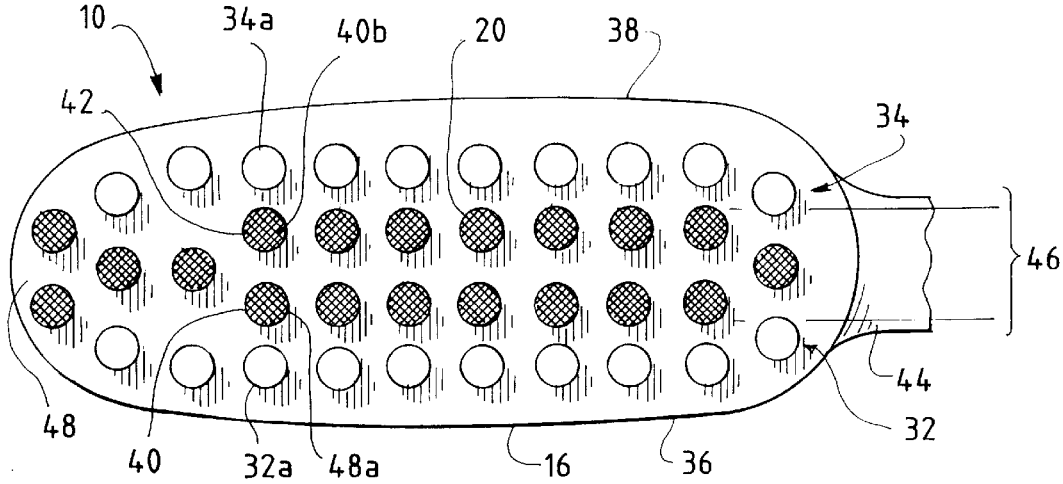
FIG. 4 is a top view showing the tufts of bristles mounted in the head of the toothbrush of FIG. 1.

FIG. 4 is a top view of the tufts of bristles 20 mounted in head 16 of toothbrush 10. The tufts of bristles are arranged in two longitudinally disposed outer rows of tufts 32 and 34 positioned along the opposite outer elongated edges 36 and 38 of head 16 (represented by open circles) and two longitudinally disposed inner rows of tufts 40 and 42 (represented by cross-hatched circles). In the configuration illustrated, rows 32 and 34 curve inwardly at either end. Also another inner row of tufts of bristles 44 (comprising three tufts) is shown.

Rows 32 and 34 of bristle tufts define an inner area 46 which lies between outer tuft rows 32 and 34. The inner rows of bristle tufts 40, 42 and 44 are positioned in this inner area 46. Also, the inner rows of tufts extend beyond the outer rows, at the distal end 48 of head 16.

The bristles of the tufts of the inner and outer rows are made of two different materials, as discussed below. Bristles 18*a* of the tufts of rows 32 and 34 are unitary, as shown in enlarged form in FIG. 5, and the bristles 18*b* of rows 40, 42 and 44 are feathered as shown in enlarged form in FIG. 6.

Figure 5:
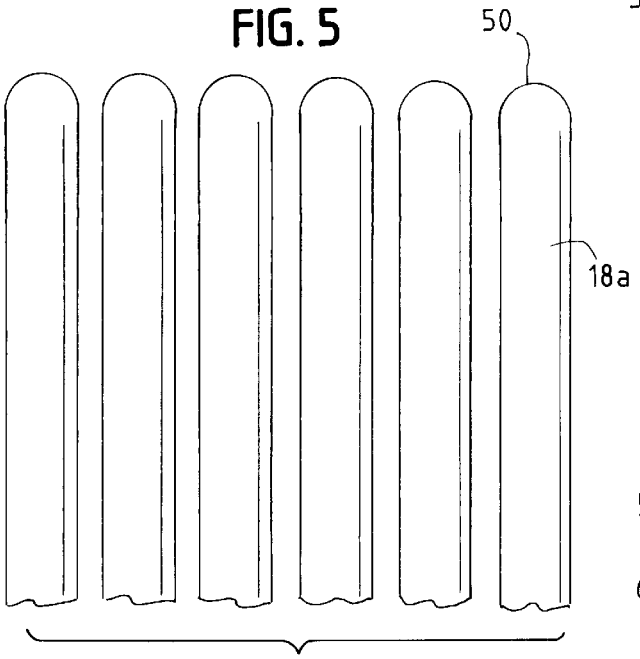
FIGS. 5 and 6 are enlarged elevation views of bristles used in making the tufts of the head of the toothbrush of FIG. 1.
Figure 6:
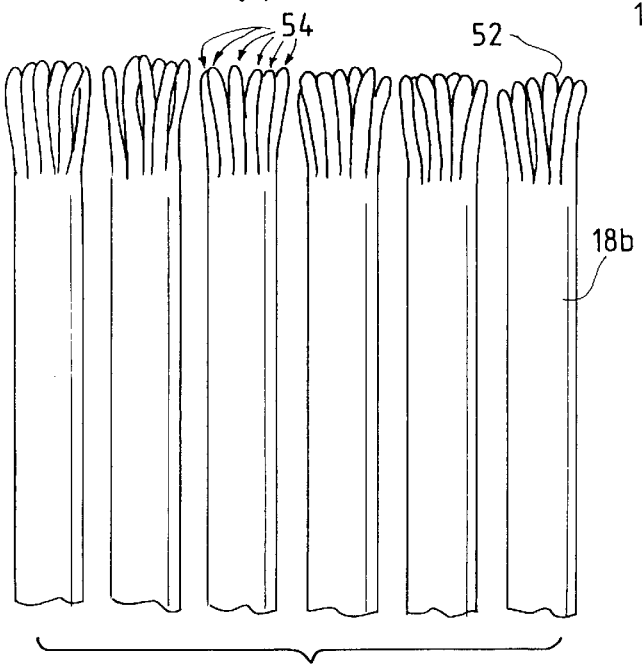

Bristles 18*a,* shown in FIG. 5, are conventional unitary bristles that may be end-rounded at their tips 50 by conventional methods. Bristles 18*a* have a generally round cross-section and a diameter of from about 0.003 to about 0.012 inches. Preferably, the diameter of these bristles will be about 0.005 to 0.010 inches and most preferably about 0.006 to 0.009 inches. Bristles 18*a* may be made from any appropriate synthetic fiber, such as nylon or polyester. Preferably bristles 18*a* will be made from nylon.

Bristles 18*b,* on the other hand, must be made from a synthetic fiber which can be easily longitudinally split or "flagged". These bristles may be end-rounded by conventional methods. Suitable such fibers include polyamides, polyesters, polyacrylates, and the like. A particularly preferred material for manufacturing these feathered bristles is nylon of a tetralocular construction supplied by duPont de Nemours under the trademark TYNEX®. This material has physical characteristics which facilitate the longitudinal splitting of the bristle tips into filaments 52 that are considerably softer and more flexible than either the remainder of the unsplit lower portions of these bristles or the entirety of bristles 18*a*. Feathered bristles 18*b* hold more dentifrice than unitary bristles although the dentifrice is spread to outside bristles 18*a* as brushing proceeds. Bristles 18*b* have a generally round cross-section and a diameter of from about 0.006 to about 0.010 inches. Preferably, the diameter of the bristles will be about 0.007 to 0.009 inches.

Bristles 18*b* may be flagged in any suitable manner, such as by subjecting the tips of these bristles to a sudden impact or by thrusting them into the rotating blades of a fan-like flagging machine. Also, although the bristles may be flagged before they are mounted to the toothbrush head, it is preferred that the flagging take place with the bristles in place in the head. Indeed, it is also contemplated that the bristles may be flagged in use, that is, in the course of brushing the teeth which similarly subjects the bristle tips to a flagging action. Finally, it should be noted that in all of the post-mounting flagging processes, it is contemplated that application of the flagging force to the bristle tufts will flag only bristles 18*b,* and leave conventional unitary bristles 18*a* intact.

The flagging of individual bristles 18*b* can extend up to about 0.5–3.0 mm of the tips of the bristles, although it is preferred that the splitting be in the range of about 1.0 to 2.0 mm. Also, due to the differing lengths of the bristles, individual bristles within a tuft and across the working surface of the tips of the bristles will vary in the depth of the longitudinal split. Preferably, the end of each bristle will be split into approximately four to six feathered tips 54.

Figure 7:
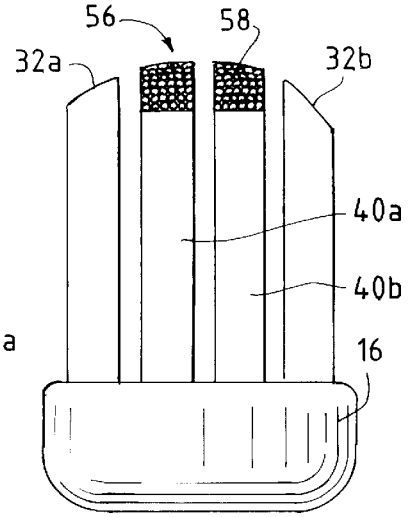
FIG. 7 is a diagrammatic representation of an end view of the toothbrush of FIG. 1.

In a particularly preferred embodiment of the invention, as illustrated in FIG. 7, the ends of all of the tufts of bristles arch upwardly in a rounded profile 56 extending laterally across the longitudinal axis of head 16 of the toothbrush. In this figure, which is a cut-away end view of the head of the toothbrush taken along line 5—5 of FIG. 3, tufts 32*a* and 32*b* of the outer rows of bristle tufts as well as tufts 40*a* and 40*b* of inner tuft rows 40 and 42 are shown in cross-section. The feathering of the ends of the bristles of tufts 40*a* and 40*b* is shown diagrammatically at 58. As is obvious from this figure, the feathering of the bristles is generally to the same absolute depth across the inner tufts, producing a relatively greater depth of feathering for the taller central bristles of the tufts.

Figure 8:
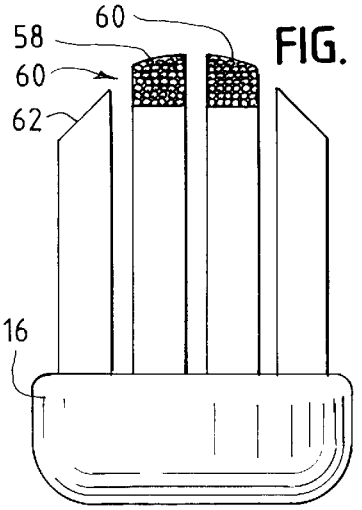
FIG. 8 is a diagrammatic representation of an end view of an alternative embodiment to that illustrated in FIGS. 1–7.
Figure 9:
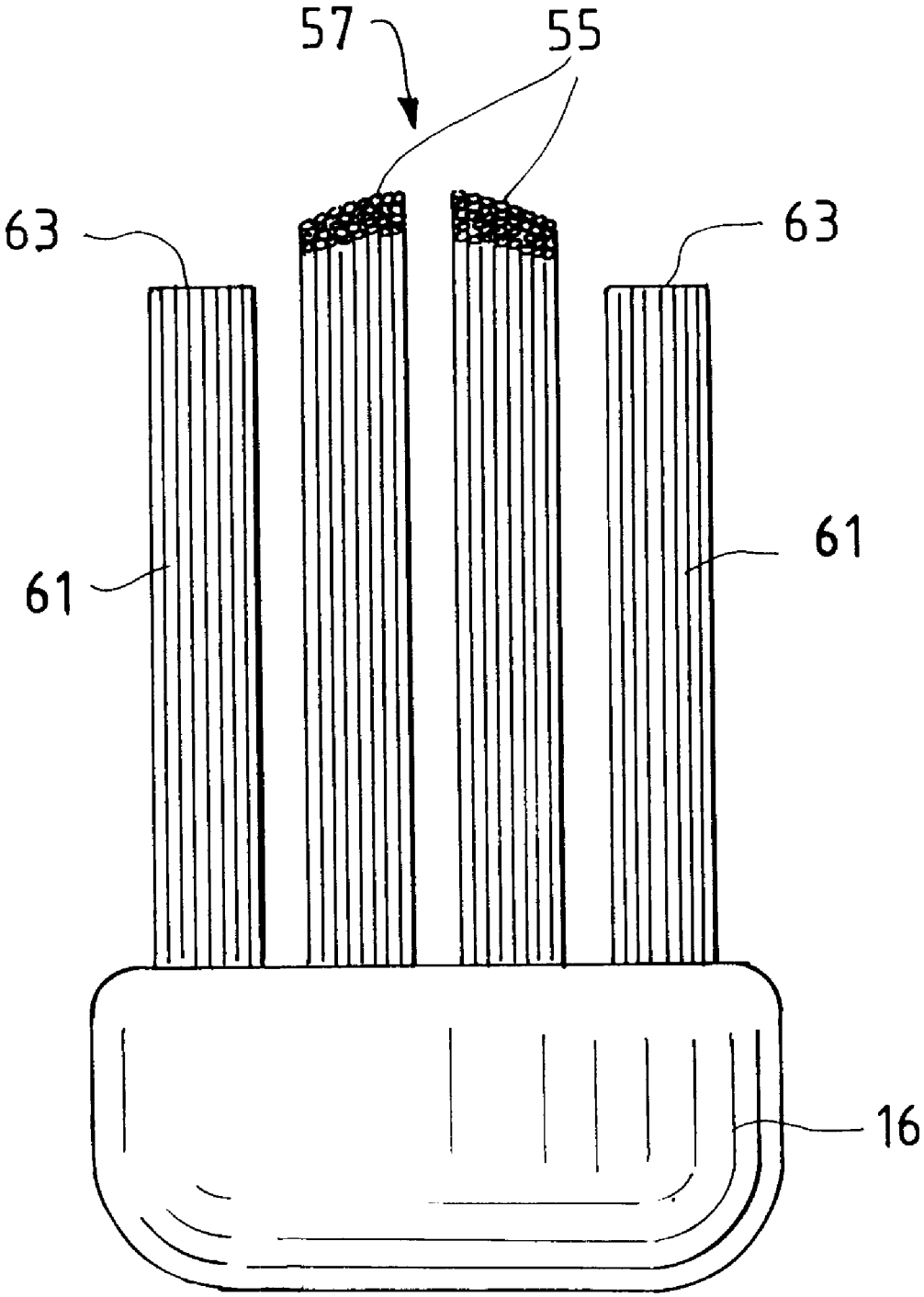
FIG. 9 is a diagrammatic representation of an end view of yet another alternative embodiment to that illustrated in FIGS. 1–8.

FIG. 8 illustrates yet another modified profile 60 in which the tufts of the inner rows of bristles are rounded at the top 60 and have a tangent flat profile at the edges 62. FIG. 9 illustrates yet another modified profile 55 in which the tufts of the inner rows of bristles are rounded as at 57 and the tufts of bristles 61 have a flat horizontal profile as at 63. The rounded profile that extends laterally across head 16, whether as in FIG. 7, FIG. 8, or FIG. 9, improves the penetration of the inner rows of tufts of bristles into the gingival sulcus while reducing the risk of gingival abrasion from individual protruding bristles. Both profiles are achieved using conventional bristle cutting techniques.

Figure 10:
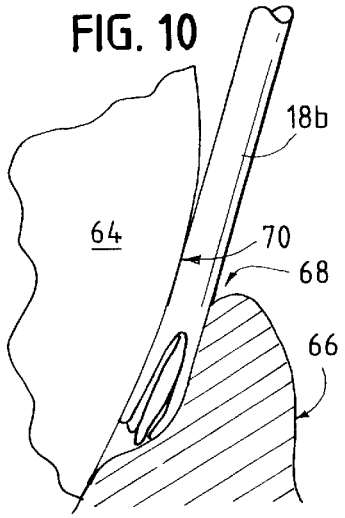
FIG. 10 is a diagrammatic representation of a portion of a tooth in cross-section with adjacent gingiva and the split tips of a bristle of the toothbrush of FIG. 1 penetrating the gingival sulcus.

When the user positions the head of the toothbrush of the present invention in his or her mouth, one of the outer rows of tufts of bristles contacts the exposed tooth surfaces while the feathered bristles of the inner rows penetrate the gingival sulcus. This penetration is shown diagrammatically in FIG. 10 in which a portion of a tooth is shown in cross-section at 64 adjacent a portion of the gingiva 66 with the gingival sulcus 68 therebetween. Feathered or split tips 54 of an individual bristle 18*b* are shown penetrating the gingival sulcus. Thus, while the brush head is oscillated or rocked back and forth, these thin, flexible, and soft feathered tips of the bristle tufts are able to reach into and remove plaque and debris from the gingival sulcus, massage the gum the gum line and clean exposed tooth surface 70 as well as the spaces between adjacent teeth.

While particular embodiments of the present invention have been shown and described, modifications may be made in the invention without departing from the teachings of the present invention. Accordingly, this invention is intended to comprise all embodiments within the scope of the appended claims.

What we claim is:

1. A toothbrush having an elongated handle and an elongated head comprising:

a plurality of tufts of bristles mounted in the head and projecting therefrom;

the tips of the tufts of bristles forming at least two rounded peaks extending laterally across the head;

the plurality of tufts of bristles arranged in at least two longitudinally disposed outer rows defining an inner area lying therebetween and at least one longitudinally disposed inner row positioned in the inner area; and the tips of the inner rows of bristles being feathered and the tips of the outer rows of bristles being unitary.

2. The toothbrush of claim 1 in which the tufts of bristles mounted in the head project generally perpendicularly therefrom.

3. The toothbrush of claim 1 in which at least three rounded peaks extend laterally across the head.

4. The toothbrush of claim 1 in which the tips of the tufts are also cut in a half moon profile that arches upwardly across the longitudinal axis of the head.

5. The toothbrush of claim 1 including at least two longitudinally disposed inner rows of tufts.

6. The toothbrush of claim 1 in which the tips of the tufts form a rounded profile that arches upwardly across the longitudinal axis of the head.

7. The toothbrush of claim 1 in which the tips of the tufts form a profile that is rounded at the top, has a tangent flat profile at the edge and arches upwardly across the longitudinal axis of the head.

8. The toothbrush of claim 1 in which the tufts are mounted into preformed holes.

9. The toothbrush of claim 1 in which the bristles of the outer rows of tufts have a generally round cross-section and a diameter of from about 0.003 to about 0.012 inches.

10. The toothbrush of claim 1 in which the bristles of the outer rows of tufts have a generally round cross-section and a diameter of from about 0.005 to about 0.010 inches.

11. The toothbrush of claim 1 in which the bristles of the outer rows of tufts have a generally round cross-section and a diameter of from about 0.006 to about 0.009 inches.

12. The toothbrush of claim 1 in which the bristles of the inner row of tufts are made of a tetralocular construction.

13. The toothbrush of claim 1 in which the tips of the bristles of the inner row of tufts are flagged.

14. The toothbrush of claim 1 in which the tips of the bristles of the inner row of tufts are end-rounded prior to being feathered.

15. The toothbrush of claim 1 in which the bristles of the inner row of tufts have a generally round cross-section and a diameter of from about 0.006 to about 0.009 inches.

16. The toothbrush of claim 1 in which the bristles of the inner row of tufts have a generally round cross-section and a diameter of from about 0.007 to about 0.009 inches.

17. A toothbrush having an elongated handle and an elongated head comprising:

a plurality of tufts of bristles mounted in the head and projecting therefrom;

the tips of the tufts of bristles forming at least two rounded peaks extending laterally across the head;

the plurality of tufts of bristles arranged in at least two longitudinally disposed outer rows defining an inner area lying therebetween and at least one longitudinally disposed inner row positioned in the inner area;

the tips of the inner rows of bristles being feathered; and the tufts of bristles of the inner row extending beyond the last tufts of the bristles in the outer rows.

18. A toothbrush having an elongated handle and an elongated head comprising:

a plurality of tufts of bristles mounted in the head and projecting therefrom;

the tips of the tufts of bristles forming at least two rounded peaks extending laterally across the head;

the plurality of tufts of bristles arranged in at least two longitudinally disposed outer rows defining an inner area lying therebetween and at least one longitudinally disposed inner row positioned in the inner area;

the tips of the inner rows of bristles being feathered; and the outer rows of tufts curving inwardly at either end.

19. A toothbrush having an elongated handle and an elongated head comprising:

a plurality of tufts of bristles mounted in the head and projecting therefrom;

the tips of the tufts of bristles forming at least two rounded peaks extending laterally across the head;

the plurality of tufts of bristles arranged in at least two longitudinally disposed outer rows defining an inner area lying therebetween and at least one longitudinally disposed inner row positioned in the inner area;

the tips of the inner row of bristles being feathered; and the tips of the bristles of the outer rows of tufts being unitary and end-rounded.

20. A toothbrush having an elongated handle and an elongated head comprising:

a plurality of tufts of bristles mounted in the head and projecting generally perpendicularly therefrom;

the tips of the tufts of bristles forming at least two rounded peaks extending laterally across the head;

the plurality of tufts of bristles arranged in at least two longitudinally disposed outer rows defining an inner area lying therebetween and at least one longitudinally disposed inner row positioned in the inner area;

the tips of the inner row of bristles being feathered and the tips of the outer rows of bristles being unitary; and the tips of the tufts are also cut in a rounded moon profile that arches upwardly across the longitudinal axis of the head.

21. A toothbrush having an elongated handle and an elongated head comprising:

a plurality of tufts of bristles mounted in the head and projecting generally perpendicularly therefrom;

the tips of the tufts of bristles forming at least two rounded peaks extending laterally across the head;

the plurality of tufts of bristles arranged in at least two longitudinally disposed outer rows defining an inner area lying therebetween and at least one longitudinally disposed inner row positioned in the inner area, the bristles of the outer rows of tufts having a generally round cross section and diameter of from about 0.006 and about 0.009 inches and the bristles of the inner row of tufts having a generally round cross section and diameter of from about 0.007 and about 0.009 inches;

the tips of the inner row of bristles being feathered and the tips of the outer rows of bristles being unitary; and the tips of the tufts form a rounded moon profile that arches upwardly across the longitudinal axis of the head.

* * * * *